US010993514B2

(12) United States Patent
Wright et al.

(10) Patent No.: US 10,993,514 B2
(45) Date of Patent: May 4, 2021

(54) FASHION ACCESSORY AND METHOD OF MAKING

(71) Applicant: Ann Williams Group LLC, Bloomfield, MI (US)

(72) Inventors: Sheila A. Wright, Bloomfield, MI (US); Jeannine Joyce Caesar, Royal Oak, MI (US); Colleen Elliott, Clawson, MI (US)

(73) Assignee: ANN WILLIAMS GROUP LLC, Bloomfield, MI (US)

( * ) Notice: Subject to any disclaimer, the term of this patent is extended or adjusted under 35 U.S.C. 154(b) by 0 days.

(21) Appl. No.: 16/276,736

(22) Filed: Feb. 15, 2019

(65) Prior Publication Data

US 2020/0260825 A1 Aug. 20, 2020

(51) Int. Cl.

| | |
|---|---|
| ***A44C 25/00*** | (2006.01) |
| ***A44C 27/00*** | (2006.01) |
| ***B44C 1/10*** | (2006.01) |
| *G09F 3/02* | (2006.01) |
| *G09F 3/10* | (2006.01) |

(52) U.S. Cl.

CPC ..... *A44C 25/007* (2013.01); *A44C 27/007* (2013.01); *B44C 1/105* (2013.01); *G09F 3/02* (2013.01); *G09F 3/10* (2013.01); *G09F 2003/023* (2013.01)

(58) Field of Classification Search

CPC ..... A44C 25/007; A44C 27/007; A44C 3/008; A44C 15/0025; A44C 15/004; A44C 25/00; A44C 25/001; B44C 1/105; G09F 3/02; G09F 3/10; G09F 2003/023

USPC ..... 63/21, 23

See application file for complete search history.

(56) References Cited

U.S. PATENT DOCUMENTS

| | | | | |
|---|---|---|---|---|
| 5,491,006 | A * | 2/1996 | Johnson | B44C 1/105 428/13 |
| 2003/0201893 | A1* | 10/2003 | Redburn | A45C 13/42 340/572.8 |
| 2006/0037358 | A1* | 2/2006 | Zuffoletto | A44C 25/007 63/1.11 |
| 2012/0312718 | A1* | 12/2012 | Canright | A44C 27/00 206/575 |
| 2016/0213186 | A1* | 7/2016 | Rezny | B43L 1/00 |

(Continued)

OTHER PUBLICATIONS

ResinObsession.com, *Puffy sticker resin bracelet tutorial*, Aug. 7, 2014, https://www.resinobsession.com/resin-tutorials/puffy-sticker-resin-bracelet-tutorial/, Accessed Jan. 4, 2019.

(Continued)

*Primary Examiner* — Jack W Lavinder

(74) *Attorney, Agent, or Firm* — The Dobrusin Law Firm, P.C.

(57) ABSTRACT

The present teachings provide for a fashion accessory, a kit comprising components of the fashion accessory, and method for constructing the fashion accessory utilizing adhesive decorations for the imaginative configuration of wearable articles. The adhesive decorations are combined to form charms, which are capable of being affixed to wearable articles. The fashion accessory includes one or more first adhesive decorations and one or more second adhesive decorations, which provide for one or more charms, which affix to wearable articles.

18 Claims, 4 Drawing Sheets

(56) References Cited

U.S. PATENT DOCUMENTS

2018/0352919 A1* 12/2018 Cucchiara ..... A44C 25/007

OTHER PUBLICATIONS

MelissaAndDoug.com, *Design-Your-Own Bracelets*, https://www.melissaanddoug.com/design-your-own-bracelets/4217.html, Accessed Jan. 4, 2019.

GageGirl.com, *Dec. 2017 Cocoa Daisy Dori Standard Kit*, Nov. 29, 2017, http://www.gagegirl.com/planners/december-2017-cocoa-daisy-dori-standard-kit/, Accessed Jan. 4, 2019.

* cited by examiner

FASHION ACCESSORY AND METHOD OF MAKING

FIELD

The present teachings generally relate to a fashion accessory, a kit comprising components of the fashion accessory, and method for constructing the fashion accessory. More specifically, the present teachings relate to a fashion accessory, kit, and method utilizing three dimensional adhesive pieces and specifically adhesive decorations for the imaginative construction of wearable articles.

BACKGROUND

Jewelry making is an activity enjoyed by children as an outlet to express creativity and produce a final product that can be worn, displayed, and enjoyed over time. Charms have been used to enhance jewelry and customize the jewelry's appearance while maintaining the option to remove or replace charms with ease.

Conventional charms are provided as single pieces, which lack individual customizability. Furthermore, the selection of the wearable article (e.g., necklace) upon which the charm is configured to attach may be limited. Conventional charms are also constructed from expensive materials and as a result, providing for a large quantity of charms in a single kit is cost prohibitive.

It would be desirable to provide a fashion accessory comprising charms, wherein the charms are customizable. It would be desirable to provide a fashion accessory whereby the wearable article and the charms are constructed from materials that provide for a wide variety of choices in constructing the fashion accessory without being cost-prohibitive. It would be desirable to provide a fashion accessory where charms may be connected to a variety of wearable articles.

SUMMARY

The present disclosure relates to a fashion accessory comprising: one or more first adhesive decorations, one or more second adhesive decorations, and a wearable article; wherein the one or more first adhesive decorations and the one or more second adhesive decorations comprise a face having a design and a back; wherein the one or more first adhesive decorations and the one or more second adhesive decorations assemble to form a charm; and wherein the charm is connected the wearable article so that the charm extends from the wearable article.

The present disclosure relates to a kit for a fashion accessory comprising: a plurality of adhesive decorations, and a wearable article; wherein the plurality of adhesive decorations comprise a face having a design and a back having a sticky surface; wherein the plurality of adhesive decorations assemble to form a charm; and wherein the assembly of the charm further includes assembly to the wearable article.

The present disclosure relates to a method for assembling a fashion accessory comprising: applying a first adhesive decoration to a second adhesive decoration to form a charm, and affixing the charm to a wearable article; wherein the first adhesive decoration and the second adhesive decoration comprise a face having a design and a back.

DESCRIPTION

Figure 1:
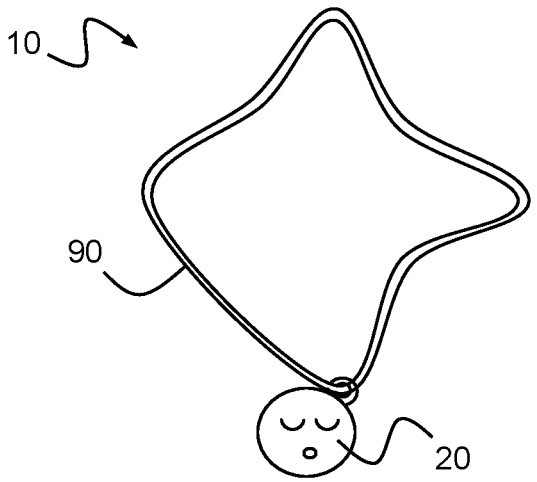
FIG. 1 illustrates a plan view of a fashion accessory.

The present teachings meet one or more of the above needs by providing one or more fashion accessories, one or more kits, and a method described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the description herein, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The fashion accessory may function to provide a user with a creative outlet to construct functional, wearable articles having charms. There may be one or more fashion accessories. The fashion accessory may be provided as a kit comprising individual components configured to be assembled by employing the method of the present disclosure. The fashion accessory may include one or more charms, adhesive decorations, one or more attachment members, one or more wearable articles, auxiliary decoration, or a combination thereof. The fashion accessory may generally be a wearable article with one or more charms attached via attachment devices, one or more attachment members, or both. The fashion accessory may include one or more wearable articles and one or more charms. For example, the fashion accessory may include several necklaces and a plurality of adhesive decorations to provide for the construction of multiple wearable articles with any combination of charms. As another example, the fashion accessory may include a set of different types of wearable articles (e.g., bracelets, necklaces, earrings, rings, pins, anklets, belts, hair decorations). The fashion accessory may include components that are intended for use with or are only compatible with certain other components of the fashion accessory. For example, larger charms may be intended for use with a necklace, whereby the larger charm is intended as a central pendant of a necklace. As another example, a charm may have an attachment member that is compatible only with a certain type of attachment device (e.g., a large diameter split ring (i.e., attachment device) may only be compatible with a charm having an attachment member of comparable size). While the configuration of the individual components of the fashion accessory may be intended for a particular use, as described above, such configuration may represent only a pre-determined (by the manufacturer) method by which the fashion accessory is to be configured but the crafter may assemble the fashion accessory in any way they so desire.

The fashion accessory may be enjoyed primarily by children but adults may also participate in interacting with the fashion accessory. The fashion accessory may be employed to capture the attention of the user and provide an outlet for creativity. The fashion accessory may be enjoyed upon initial assembly and even beyond initial assembly. For example, the fashion accessory may be enjoyed beyond initial assembly by removing and replacing charms with respect to the wearable article. The charms of the fashion accessory may be traded amongst children having their own fashion accessories. The fashion accessory may be enjoyed for the purpose of fashion, dress-up, conveying moods (e.g., selecting an emoji charm reflecting the wearer's mood for the day and attaching it to the wearable article), or a combination thereof. Charms that are lost or damaged may be easily replaced by assembling new charms and attaching them to the wearable article.

The present disclosure provides a kit for a fashion accessory as described herein. The kit may include a plurality of adhesive decorations, one or more wearable articles, one or more attachment devices, one or more auxiliary decorations, or a combination thereof. The kit may comprise only adhesive decorations, the kit may be a refill kit to complement a kit having all of the aforementioned elements, or both. The refill kit may provide for charms that may be attached to wearable articles already possessed by the crafter from an original kit. The refill kit may further include one or more attachment devices, which replace lost or broken attachment devices from an original kit. The kit or refill kit may include charms having a single theme or a mix of themes. For example, the kit or refill kit may provide only charms configured with a medieval theme (e.g., castles, dragons, princesses, horses, swords, knights, weapons, and the like). As another example, the kit or refill kit may provide charms having the different themes of creatures, numbers, letters, and faces.

The fashion accessories discussed herein may be created via a method discussed herein. The method may include one or more of the steps discussed herein. The steps as discussed herein may be performed in virtually any order unless a specific order is provided. The method may include a step of applying a first adhesive decoration to a second adhesive decoration to form a charm and a step of affixing the charm to a wearable article. The step of affixing the wearable article to the charm may be performed in the same step as applying a first adhesive decoration to a second adhesive decoration; wherein the wearable article or a portion thereof is located between a back of the first adhesive decoration and the back of the second adhesive decoration and thereafter the first adhesive decoration is applied to the second adhesive decoration so that the wearable article is sandwiched between the first and second adhesive decoration. The step of affixing the wearable article to the charm may be performed by applying the wearable article to one or more attachment members of the charm. For example, a wearable article comprising a string may be strung through an attachment member (e.g., an integral loop) of the charm. A wearable article may be extended between a first adhesive decoration and a second adhesive decoration and the first adhesive decoration and the second adhesive decoration connect together sandwiching the wearable article therebetween to form a connection. The step of affixing the wearable article to the charm may comprise applying an attachment device to one or more attachment members of the charm. The attachment device may be applied to the wearable article. The method may include a step of applying a wearable article to a body part of a user. The method may include a step of applying a wearable article to a decorated article. For example, the attachment device may be a split ring that is threaded through both the attachment member of the charm and the wearable article. All or a portion of a wearable article may be extended through the attachment member to form a connection. Any of the aforementioned steps may be repeated for a plurality of first adhesive decorations and a plurality of second adhesive decorations; wherein a plurality of charms may be affixed to one wearable article or a plurality of wearable articles. The method may include a step of removing a backing from the adhesive decoration so that the tacky substance is exposed. The method may include a step of punching out a center of a die cut attachment member. The method may include a step of cutting a slit in the attachment member to open the attachment member so that the wearable article may be pushed through the slit to form a connection between the attachment member and the wearable article. A cut attachment member may be wrapped around one or more wearable articles to form a connection. The method may include a step of removing a charm from a first wearable article and attaching the charm to a second wearable article. The method may include stringing a shoelace through a wearable article by stringing the shoelace through an attachment member on a first lobe of the wearable article and then through an attachment member on a second lobe of the wearable article. The method may include a step of assembling a wearable article (e.g., cutting a length of string from a larger length of string, braiding string together, attaching a closure device (i.e., a device for securing the wearable article on a body part of the wearer) to the wearable article, and/or tying the wearable article into knots to create loops). The method may include a step of decorating the fashion accessory with auxiliary decoration. The step of decorating the fashion accessory with auxiliary decoration may comprise decorating the adhesive decorations, decorating the wearable article, or both. The step of decorating the wearable article with auxiliary decoration may include stringing beads on the wearable article, affixing pre-assembled charms to the wearable article, applying pendants to the wearable article, or a combination thereof. The step of decorating the adhesive decorations may be performed before or after the first adhesive decoration and second adhesive decoration are assembled to form a charm. The step of decorating the adhesive decorations may include painting the adhesive decoration, drawing on the adhesive decoration, or both.

The adhesive decorations may function to form a charm in an assembled state. The adhesive decorations may be provided as a set of adhesive decorations with complementary pairs of first adhesive decorations and second adhesive decorations. There may be any number of complementary pairs of adhesive decorations in a set. The complementary pairs may comprise the same theme, the same design, different themes, different designs, or a combination thereof. For example, a set of adhesive decorations may include a dozen pairs each having the same emoji face (same theme and same design). As another example, a set of adhesive decorations may include a dozen pairs each having emoji faces having different expressions (same theme, different design). As yet another example, a set of adhesive decorations may include a dozen pairs each having a different design chosen from an object, an animal, a figure, and a setting (different theme, different design). A pair of adhesive decorations—comprising a first adhesive decoration and a second adhesive decoration—may comprise two adhesive decorations exhibiting reflection symmetry (with respect to a reflection plane disposed between and equidistant from the adhesive decorations), whereby when the adhesive decorations are applied together back-to-back the profiles of the adhesive decorations align. Reflection symmetry may ensure that portions of the back of the adhesive decorations are not exposed in an assembled state. The reflection symmetry of the adhesive decorations may be particularly helpful where a tacky substance is disposed on the backs of the adhesive decoration in order to avoid exposure of the tacky substance when the adhesive decorations are in an assembled state. Alignment of the adhesive decorations back-to-back in accordance with the reflection symmetry of the adhesive decorations may be achieved by providing a first adhesive decoration and a second adhesive decoration having the same or similar design and/or shape (e.g., both adhesive decorations have the same depiction imprinted upon them and the same profile) however, such alignment may also be achieved by providing an adhesive decoration having the same profile but a different depiction imprinted upon them (e.g., a first adhesive decoration having a bunny depiction and a second adhesive decoration having the profile of a bunny but a rainbow depiction). The shapes of the adhesive decorations may be a perimeter of the adhesive decoration. The perimeters of the adhesive decorations may be mirror images or reverse mirror images so that the perimeters align and no adhesive is exposed. The adhesive decorations may have a length of about 0.5 cm or more, about 1 cm or more, about 1.5 cm or more, about 10 cm or less, about 5 cm or less, or even 3 cm or less. The adhesive decorations may have a width of about 0.5 cm or more, about 1 cm or more, about 1.5 cm or more, about 10 cm or less, about 5 cm or less, or even 3 cm or less. The adhesive decorations may have a thickness of about 1 cm or less, about 0.8 cm or less, about 0.6 cm or less, about 0.01 cm or more, about 0.1 cm or more, or even about 1 cm or more. The adhesive decorations may be symmetrical, asymmetrical, round, oval, square, irregular shaped, triangular, human shaped, animal shaped, shaped like an object, or a combination thereof. The adhesive decorations may be stickers, puffy stickers or both. The stickers may be substantially planar stickers having a 2D design. The puffy stickers may be 3D stickers with a depth imparted by a face extending from the longitudinal plane, lateral plane, a surface that forms a connection, or a combination thereof of the puffy sticker. The puffy stickers may have a depth varying across the face of the puffy sticker so that the puffy sticker has texture. The adhesive decorations may comprise a face, a back, a theme, a design, a filling, an attachment member, auxiliary decoration, or a combination thereof.

The face may function to be outwardly visible to a viewer when the adhesive decorations assemble into a charm and provide a three-dimensional characteristic to the adhesive decorations. The face may include a forward surface, facing away from the back, and a rear surface, facing toward the back. The face may be convex or extend outward along an axis normal to the longitudinal plane of the adhesive decoration ("depth axis"). The depth of the face may have a varying elevation. The design of the face may exhibit a three-dimensional effect. The face may be hollow (i.e., having a concave portion defining a void between the face and the back), solid (i.e., solid material extending to the back), or both. As an example of a hollow face, the face may comprise a shaped polymer sheet, with a convex side and a concave side, and the hollow portion may be the space defined by the concave side which abuts the back. As an example of a solid face, the face may comprise an open cell foam that has a convex side and a flat side and the space therebetween is foam. The face may comprise resin, foam, polymer (e.g., nylon, acrylic, PVC, polyethylene, polypropylene, polycarbonate), wood, ceramic, paper, metal, or a combination thereof. The material comprising the face may be suitable for accepting and retaining pigmentation as a result of the crafter applying a design to the adhesive decoration such as by painting, coloring, drawing, or a combination thereof. More specifically, the material may be rough or porous in order for the pigment to permeate or set within the material. The face may comprise a design or may be free of a design. The face may be opaque, translucent or transparent. A face that is transparent or translucent may enable a filling, a design on the back, or both to be visible. For example, the face may comprise clear polyethylene enabling a viewer to see a filling dispensed in the hollow face. The face may be embossed, where the embossment imparts a texture on the adhesive decoration, the embossment complements the design, or both.

The back may function as a substrate for tacky material. The back may include a forward surface, facing toward the face, and a rear surface, facing away from the face. The rear surface may include a tacky material. The rear surface may be free of tacky material. For example, a first adhesive decoration may include tacky material and a second adhesive decoration may be free of tacky material. The forward surface may include a design or be free of a design. Where the forward surface includes a design, the forward surface may be visible through the face. For example, the face may be clear and a design may be imprinted on the forward surface of the back so that the design on the back may be visible through the clear face.

The tacky material may function to adhere the adhesive decoration to a surface. The tackiness of the tacky material may be non-permanent (i.e., sufficient to enable the adhesive decoration to be removed from a surface or another adhesive decoration without damage to the adhesive decoration, the sticky substrate, or both) or permanent (i.e., not removable without damage to the adhesive decoration, the sticky substrate, or both). The tacky material may be tacky before a charm is formed. For example, the tacky material may be a one-part material or a peel and stick layer. The tacky material may be a tacky material that is used on a sticker. The tacky material may only become tacky upon connection with another tacky material. For example, the tacky material may be a two-part adhesive such that when the two tacky materials are connected together, they react and become tacky. The tacky material may be a moisture cure adhesive. The tacky material may be rubber, acrylic, acrylic blend, epoxy, one-part adhesive, two-part adhesive, or a combination thereof. The type of tacky material may be chosen in accordance with the material comprising the back.

The adhesive decoration may comprise a face that is a transparent polymer shell defining a void between the face and the back. The void may include a filling (e.g., glitter). The filling in the void may be visible through the face. The adhesive decoration may comprise a face comprising foam having a design imprinted upon the forward surface of the face. In another example of an adhesive decoration of the present disclosure, the adhesive decoration comprises a face comprising an epoxy resin, which is transparent, and a design imprinted upon the forward surface of the back is visible through the epoxy resin of the face.

The theme may be a single, cohesive subject of: the adhesive decorations, the wearable article, or both (e.g., a person, an animal, a creature, a character, a face, an object, food, a number, a letter, a setting, a shape, a sport, a setting, or any combination thereof). The theme may comprise individual designs which conform to the theme. For example, where the theme is letters the adhesive decorations comprise designs of different letters. As another example, where the theme is medieval, the adhesive decorations comprise designs of dragons, knights, horses, castles, princesses, or a combination thereof. The adhesive decorations of a kit may include the same theme or different themes. The complementary pair of adhesive decorations may have a single theme. Complementary pairs may have a different theme. For example, a first adhesive decoration may be an emoji and a second adhesive decoration may be a soccer ball—in such case the profiles of the first adhesive decoration and the second adhesive decoration may be substantially similar and the adhesive decorations may be assembled to form a charm.

The design may function as a depiction and likeness of a subject. The design may be embodied by pigment, embossments, depressions, a profile, or a combination thereof. The design may be pigment that is fully pre-imprinted on the adhesive decorations, partially pre-imprinted on the adhesive decorations, or absent from the adhesive decorations. For example, a partially pre-imprinted design may be an outline of a design whereby the adhesive decorations are configured to have the design applied by the crafter (e.g., coloring in with marker). The design may be present on the face, the back, or both. The design may be present on a portion of the face, a portion of the back, or both. Preferably, the design is only on the face or forward surface. For example, a portion of the face may be both free of design and transparent, enabling a design present on the back to be seen. As another example, the entirety of the face may be transparent, enabling a design present on the back to be seen. The design may be pronounced by a profile.

The profile may be the shape of the adhesive decorations as projected on a plane, viewed along an axis normal to a face or back of the adhesive decoration. The profile may include the distal perimeter of the adhesive decorations, voids within the adhesive decorations extending through the adhesive decoration along the depth axis, or both. The profile may conform to the contours of a subject depicted on the adhesive decoration or may be shaped independent of the subject depicted on the adhesive decoration. For example, where the design is a cloud, the profile of the adhesive decoration conforms to the contours of the cloud. As another example, the adhesive decoration may have a circular profile but the subject depicted on the adhesive decoration may be a horse. The profile of the first adhesive decoration and the second adhesive decoration may be mirror images or reverse mirror images of each other. The profile may include the profile of the attachment member. The profile of a complementary set of a first adhesive decoration and a second adhesive decoration may have reflection symmetry.

The subject may resemble animate life, inanimate objects, make-believe characters, settings, symbols, letters, numbers, characters, or a combination thereof. The design of an adhesive decoration may include one subject or more than one subject.

The attachment member may function to enable the adhesive decorations to attach to a wearable article. The attachment member may be an integral portion of the adhesive decorations or a component separate from the adhesive decorations. For example, an integral attachment member is a distally extending lobe of the adhesive decoration. As another example, the attachment member may be a polymer, rubber, or metal tab that may be attached to the charm by a portion of the attachment member being sandwiched between the adhesive decorations. Each adhesive decoration may include one or more attachment members. Each adhesive decoration may include a plurality of attachment members. The attachment members may extend from an edge of the adhesive decorations. One or more attachment members may extend from opposite edges of the adhesive decoration. For example, each adhesive decoration may include two attachment members and the attachment members may be located on opposing sides so that a wearable article extends through a first attachment member behind the adhesive decoration or charm and out through the second attachment member. The attachment member may be reinforced. For example, the attachment member may be reinforced by a coating on the attachment member, a grommet applied into the attachment member, a backing on the attachment member (e.g., polymer, rubber, or metal sheet applied to the rear surface of the attachment member), or a combination thereof. The attachment member may extend between the one or more first adhesive decorations and the one or more second adhesive decorations. The attachment member may be a through-hole, a loop, a void (i.e., absence of material) on the adhesive decoration. The through-hole, loop, or void may be formed integrally in the adhesive decoration when molded, die cut during the production of the adhesive decoration, or formed by the user by punching, cutting, or threading (e.g., with a needle). The attachment member may be cuttable. The attachment member may be cut either by the manufacturer or the user to form a slit so that the through-hole, the loop, or the void is opened so that the wearable article may be pushed through the slit and into the through-hole, the loop, or the void. The attachment member may be a lobe extending distally from the adhesive decoration or the attachment member may be located within the design. For example, the adhesive decoration may have the design and profile of a donut and the attachment member may be the hole in the middle of the donut. The attachment member may include a portion of the design. For example, the adhesive decoration may have the design of a cowboy swinging a lasso and the attachment member, may include a design of the lasso where the through-hole of the attachment member extends through the middle of the lasso.

The filling may function as a movable decoration. The filling may be an aesthetic decoration for the adhesive decoration acting alone or augmenting the design (e.g., design printed on the forward surface of the back). The filling may comprise any suitable decoration that is appropriately sized to fit within the face of the adhesive decoration. Specifically, the filling may include glitter, confetti, figures (i.e., small figures crafted to resemble objects, animals, creatures, or a combination thereof), liquid, gel, or a combination thereof. The filling may be metallic, sparkly, colored, transparent, or a combination thereof. For example, the filling may include both figures of fish and liquid where the fish are dispersed in the liquid—such a filling may complement an aquarium design printed on the forward surface of the back of the adhesive decoration. The filling may be free or fixed. Free filling may be filling that is free to travel within the adhesive decoration, either through an empty space within the adhesive decoration or within another filling (liquid) within the adhesive decoration. For example, free filling may be bound within the void (e.g., a hollow space) of a face defined by the forward surface and the rear surface. Fixed filling may be suspended in a medium. For example, suspended filling may be suspended within a cured, hardened resin comprising the face.

The wearable article may function to hold the charms and display the charms as the wearable article is worn or affixed to a decorated article for display. The wearable article may be a bracelet, a necklace, earrings, a ring, a pin, an anklet, a belt, a hair decoration, a rubber band, an O-ring, a shoelace, writing utensil, backpack, clothing, bag, or a combination thereof. The wearable article may comprise string, a chain, a wire, monofilament, a polymer band, or a ring. The wearable article may be constructed from filament, fabric, polymer, metal, wood, or a combination thereof. The wearable article may be worn directly on a body part of the user (e.g., ear, neck, wrist, hair, ankle) or the wearable article may be affixed to a decorated article so that the adhesive decoration is displayed on the decorated article (e.g., pencil, pen, backpack, jacket, glasses).

The attachment member may be a shoelace attachment that may function to accept a shoelace so that the shoelace attachment can be affixed to a shoe. The shoelace attachment may comprise a central portion, which is configured to be sandwiched between two of the adhesive decoration, and two lobed portions, which comprise attachment members.

The O-ring may function to accept articles of substantially uniform cross-sectional length. For example, the O-ring may be slid or rolled onto the end of a writing utensil. The O-ring and the attachment device may be substantially the same. The O-ring may be an attachment device that is specifically tailored to connect to a writing utensil.

The attachment device may function to connect a charm to a wearable article. The attachment device may provide for a permanent connection (i.e., not removable without substantial effort or damage to the charm, the attachment device, the wearable article, or a combination thereof) or a removable connection. The attachment device may include a ring that loops through both the charm and the wearable article. The attachment device may comprise a split ring, jump ring, crimp end bead tip, ball and coil ear wires, lobster clasp, bails, crimp bead, hooks, string, monofilament, wire, magnets, glue, tape, a post, or a combination thereof. For example, a split ring may be opened and applied to both a charm and a chain (wearable article) and thereafter closed to secure a charm to a link of the chain. As another example, the charm may be applied to a ring with hot-melt glue. As yet another example, the adhesive decorations of the charm may be applied back-to-back with a post in the middle where the post extends from a ring. More than one attachment device may be utilized in connecting a single charm. For example, a first split ring may be guided through the attachment member and closed by moving the ends together and a second split ring may be guided through the first split ring and the wearable article and closed by moving the ends together. More than one attachment device may accept more than one adhesive decoration. For example, two charms may be affixed to two discrete split rings and the respective split rings may be closed, the two discrete charms and split rings may be applied onto a single split ring. The fashion accessory may be free of an attachment device. More specifically, the charm may be configured to attach to the wearable article (e.g., a string) by enclosing the wearable article in-between the first bubble charm and the second bubble charm.

The fashion accessory may comprise auxiliary decoration, which may function to add decorative elements to the fashion accessory. The auxiliary decoration may comprise, beads, stickers (non-adhesive decorations), pendants, string, chains, pre-fabricated charms, markers, pen, pencil, crayon, paint, glitter, any other suitable decorative element, or a combination thereof. The auxiliary decoration may be employed to enhance the aesthetics of the fashion accessory, to give the crafter a wider range of creative choices, to extend the intriguing life of the fashion accessory, or a combination thereof. The auxiliary decoration may be employed on any portion of the fashion accessory or not at all. For example, the auxiliary decoration may comprise beads, which may be applied to a necklace in between charms. As another example, the auxiliary decoration may be paint configured for use on charms, where the constituent adhesive decorations are purposely left blank for the crafter to paint. As yet another example, the auxiliary decoration may be pen so that that the crafter may write their name on an adhesive decoration configured with a space for writing.

FIG. 1 illustrates a plan view of a fashion accessory 10 comprising a wearable article 90, which is a necklace, and a charm 20.

Figure 2A:
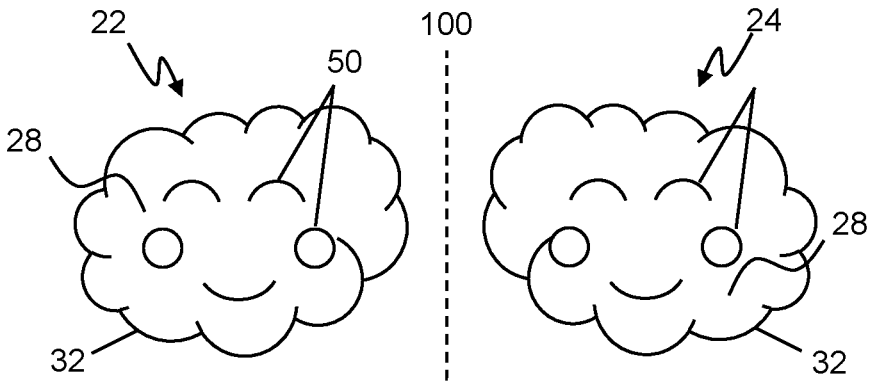
FIG. 2A illustrates a plan view of a first adhesive decoration and a second adhesive decoration.

FIG. 2A illustrates a plan view of the face 28 of a first adhesive decoration 22 and a second adhesive decoration 24. The first adhesive decoration 22 and the second adhesive decoration 24 comprises profiles 32, shown as clouds, and designs 50, which are displayed as a smiling, blushing emoji. The designs 50 of the first adhesive decoration 22 and the second adhesive decoration 24 exhibit reflection symmetry along a reflection plane 100.

Figure 2B:
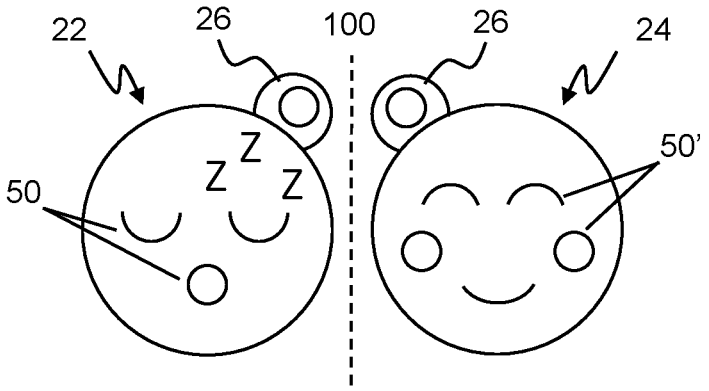
FIG. 2B illustrates a plan view of a first adhesive decoration and a second adhesive decoration having attachment members.

FIG. 2B illustrates a plan view of a first adhesive decoration 22 and a second adhesive decoration 24. The first adhesive decoration 22 and the second adhesive decoration 24 include attachment members 26 and designs 50, 50'. The attachment members 26 extend distally from the first adhesive decoration 22 and the second adhesive decoration 24 and are oriented with reflection symmetry along a reflection plane 100. The design 50 of the first adhesive decoration 22 is shown as a sleeping emoji and the design 50' of the second adhesive decoration 24 is shown as a smiling, blushing emoji. The designs 50, 50' are oriented in the same direction with respect to the attachment members 26.

Figure 3:
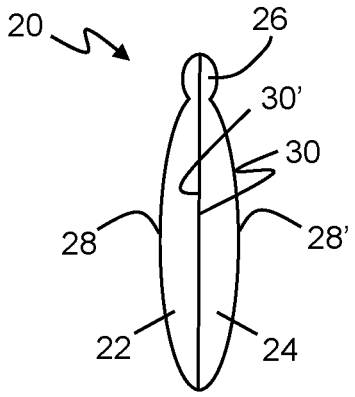
FIG. 3 illustrates a side view of a charm.

FIG. 3 illustrates a side view of a charm 20 comprising a first adhesive decoration 22 and a second adhesive decoration 24 affixed together. The backs 30, 30' of the first adhesive decoration 22 and the second adhesive decoration 24 are affixed together back-to-back; the faces 28, 28' of the first adhesive decoration 22 and the second adhesive decoration 24 are oriented away from each other. The charm 20 includes one or more attachment members 26.

Figure 4:
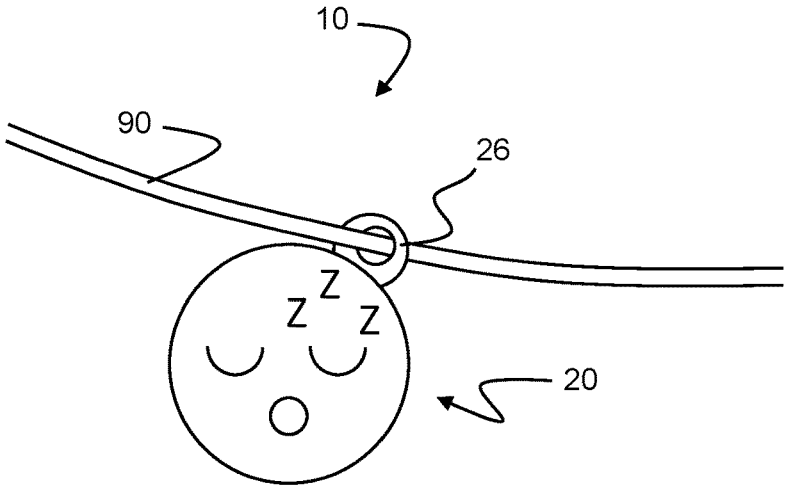
FIG. 4 illustrates a plan view of a charm attached to a wearable article.

FIG. 4 illustrates a plan view of a fashion accessory 10 with a charm 20 affixed to a wearable article 90. The wearable article 90 is displayed as a string, threaded through one or more attachment members 26 on the charm 20.

Figure 5:
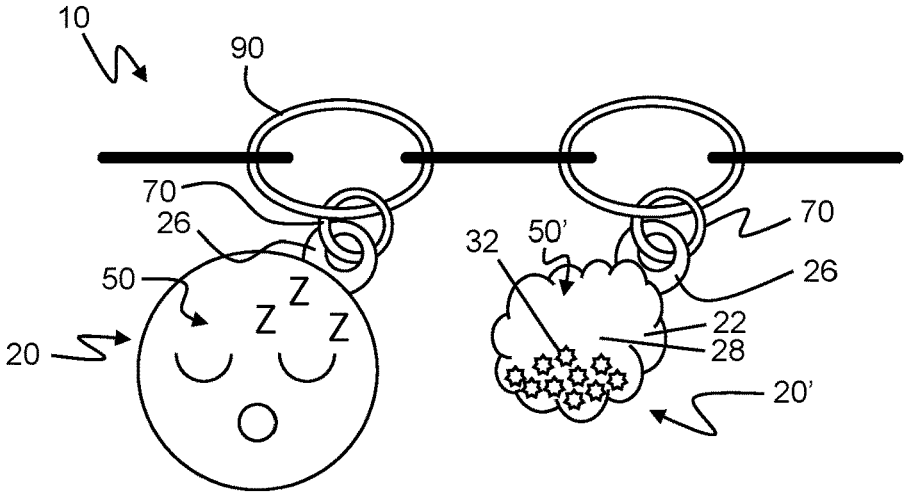
FIG. 5 illustrates a plan view of two charms attached to a wearable article.

FIG. 5 illustrates a plan view of a fashion accessory 10 with two charms 20, 20' affixed to a wearable article 90, which is shown as a chain. The charms 20, 20' include a sleepy emoji design 50 and a cloud design 50'. The two charms 20, 20' include attachment members 26. The attachment members 26 are attached to the wearable article 90 by attachment devices 70, which are shown as split rings. The charm 20' comprises filling 32 (glitter), visible through the face 28 of the first adhesive decoration 22.

Figure 6:
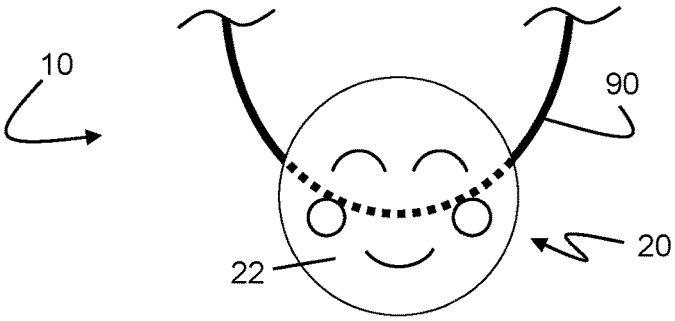
FIG. 6 illustrates a plan view of a charm attached to a wearable article.

FIG. 6 illustrates a plan view of a fashion accessory 10 with a charm 20 affixed to a wearable article 90, which is shown as a string. The charm 20 includes a first adhesive decoration 22 and a second adhesive decoration (not shown), which are affixed together back-to-back with the wearable article 90 in between.

Figure 7:
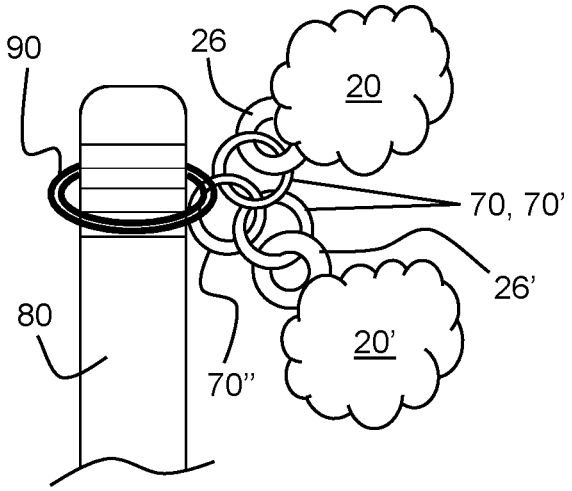
FIG. 7 illustrates a plan view of a charm attached to a wearable article, which is applied to the end of a writing utensil.

FIG. 7 illustrates two charms 20, 20' attached to a decorated article 80. Each of the two charms 20, 20' comprise attachment members 26, 26', through each of which an attachment device passes 70, 70'. The attachment devices 70, 70' are connected via a third attachment device 70", which is attached to a wearable article 90, which is an o-ring. The wearable article 90 is applied on a decorated article 80, which is a pencil, over the eraser end.

Figure 8:
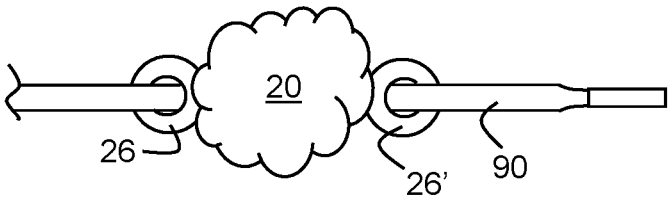
FIG. 8 illustrates a plan view of a charm attached to a wearable article.

FIG. 8 illustrates a charm 20 attached to a wearable article 90. The charm 20 includes two attachment members 26, 26' which extend distally from the charm 20 in opposing directions. The wearable article 90, which is a shoelace, is threaded through one attachment member 26, behind the charm, and up through the other attachment member 26'.

Any numerical values recited in the above application include all values from the lower value to the upper value in increments of one unit provided that there is a separation of at least 2 units between any lower value and any higher value. These are only examples of what is specifically intended and all possible combinations of numerical values between the lowest value and the highest value enumerated are to be considered to be expressly stated in this application in a similar manner. Unless otherwise stated, all ranges include both endpoints and all numbers between the endpoints.

The terms "generally" or "substantially" to describe angular measurements may mean about +/−10° or less, about +/−5° or less, or even about +/−1° or less. The terms "generally" or "substantially" to describe angular measurements may mean about +/−0.01° or greater, about +/−0.1° or greater, or even about +/−0.5° or greater. The terms "generally" or "substantially" to describe linear measurements, percentages, or ratios may mean about +/−10% or less, about +/−5% or less, or even about +/−1% or less. The terms "generally" or "substantially" to describe linear measurements, percentages, or ratios may mean about +/−0.01% or greater, about +/−0.1% or greater, or even about +/−0.5% or greater.

The term "consisting essentially of" to describe a combination shall include the elements, ingredients, components, or steps identified, and such other elements ingredients, components or steps that do not materially affect the basic and novel characteristics of the combination. The use of the terms "comprising" or "including" to describe combinations of elements, ingredients, components, or steps herein also contemplates embodiments that consist essentially of the elements, ingredients, components, or steps.

Plural elements, ingredients, components, or steps can be provided by a single integrated element, ingredient, component, or step. Alternatively, a single integrated element, ingredient, component, or step might be divided into separate plural elements, ingredients, components, or steps. The disclosure of "a" or "one" to describe an element, ingredient, component, or step is not intended to foreclose additional elements, ingredients, components, or steps.

ELEMENTS

10 Fashion accessory
20 Charm
22 One or more first adhesive decorations
24 One or more second adhesive decorations
26 Attachment member
28 Face
30 Back
32 Profile
36 Filling
40 Auxiliary decoration
50 Design
70 Attachment device
80 Decorated article
90 Wearable article
100 Reflection plane

What is claimed is:

1. A fashion accessory comprising:

a) one or more first adhesive decorations, b) one or more second adhesive decorations, and c) a wearable article;

wherein each of the one or more first adhesive decorations and the one or more second adhesive decorations comprise:

a face including a design that is fully pre-imprinted on the one or more first adhesive decorations and the one or more second adhesive decorations, a back including a peel and stick adhesive thereon, and an attachment member integrally formed thereto, configured to receive the wearable article, and including a lobe extending distally from each of the one or more first adhesive decorations and the one or more second adhesive decorations, and each of the lobes including a through-hole extending therethrough;

wherein the one or more first adhesive decorations and the one or more second adhesive decorations assemble, by mating the one or more first adhesive decorations and the one or more second adhesive decorations back-to-back, to form a charm;

wherein, upon mating the one or more first adhesive decorations and the one or more second adhesive decorations back-to-back, the attachment member of the one or more first adhesive decorations and the attachment member of the one or more second adhesive decorations align and directly contact one another;

wherein the charm is connected to the wearable article via the attachment member of the one or more first adhesive decorations and the attachment member of the one or more second adhesive decorations;

wherein the peel and stick adhesive is selected from a rubber, an acrylic, an acrylic blend, an epoxy, a one-part adhesive, a two-part adhesive, or a combination thereof;

wherein the one or more first adhesive decorations and the one or more second adhesive decorations comprise foam, the foam extending between the face and the back; and wherein the wearable article is a necklace, a ring, earrings, a pin, an anklet, a belt, a hair decoration, or a combination thereof.

2. The fashion accessory of claim 1, wherein the one or more first adhesive decorations and the one of the one or more second adhesive decorations each have a profile, the profile of the one or more first adhesive decorations and the profile of the one or more second adhesive decorations having reflection symmetry with respect to one another.

3. The fashion accessory of claim 1, wherein the fashion accessory includes an attachment device that attaches the charm to the wearable article.

4. The fashion accessory of claim 3, wherein the attachment device is a ring that selectively opens and closes so that the charm is capable of being removed and re-affixed without destruction of the charm.

5. The fashion accessory of claim 1, wherein the design of the one or more first adhesive decorations and the design of the one or more second adhesive decorations are mirror images of one another.

6. The fashion accessory of claim 1, wherein the wearable article is sandwiched between the back of the one or more first adhesive decorations and the back of the one or more second adhesive decorations so that the charm is directly connected to the wearable article.

7. A kit for a fashion accessory comprising:

a) a plurality of adhesive decorations, and b) one or more wearable articles, wherein the one or more wearable articles are one or more necklaces, bracelets, rings earrings, pins, anklets, belts, hair decorations, or a combination thereof;

wherein each of the plurality of adhesive decorations comprise:

a face including a design that is fully pre-imprinted on each of the plurality of adhesive decorations, a back having a sticky surface, and an attachment member;

wherein the sticky surface includes a peel and stick adhesive;

wherein the plurality of adhesive decorations assemble, by mating two of the plurality of adhesive decorations back-to-back, to form one or more charms; and wherein the assembly of the one or more charms further includes assembly to one of the one or more wearable articles.

8. The kit of claim 7, wherein the kit further includes a plurality of attachment devices each including a ring;

wherein the one or more charms are connectable to the one or more wearable articles via the attachment member of each of the plurality of adhesive decorations; and wherein each of the plurality of attachment devices loops through both of one of the one or more charms and one of the one or more wearable articles so that one of the plurality of attachment devices connects one of the one or more charms to one of the one or more wearable articles.

9. The kit of claim 7, wherein at least two of the plurality of adhesive decorations are complementary pairs that connect together to form the one or more charms.

10. The kit of claim 9, wherein the design of each of the plurality of adhesive decorations in each of the complementary pairs are different or substantially similar.

11. The kit of claim 7, wherein the attachment member includes a lobe extending distally from the from the plurality of adhesive decorations; and wherein the lobe includes a through-hole extending therethrough.

12. The kit of claim 7, wherein the plurality of adhesive decorations comprise foam, the foam extending between the face and the back.

13. The kit of claim 7, wherein the peel and stick adhesive is selected from a rubber, an acrylic, an acrylic blend, an epoxy, a one-part adhesive, a two-part adhesive, or a combination thereof.

14. A method for assembling a fashion accessory comprising:

a) applying a first adhesive decoration to a second adhesive decoration to form a charm, and b) affixing the charm to a wearable article, wherein the wearable article is a necklace, a bracelet, a ring, earrings, a pin, an anklet, a belt, a hair decoration, or a combination thereof;

wherein each of the first adhesive decoration and the second adhesive decoration comprise:

a face including a design that is fully pre-imprinted on the first adhesive decoration and the second adhesive decoration, a back, and an attachment member integrally formed thereto.

15. The method of claim 14, wherein the step of affixing the wearable article to the charm is performed in a same step as applying the first adhesive decoration to the second adhesive decoration so that the wearable article is sandwiched between the back of the first adhesive decoration and the back of the second adhesive decoration.

16. The method of claim 14, wherein the method includes a step of extending the wearable article through the attachment member of the first adhesive decoration and the attachment member of the second adhesive decoration so that the charm is suspended from the wearable article by the attachment member of the first adhesive decoration and the attachment member of the second adhesive decoration; and wherein the attachment member includes a lobe extending distally from the from the first adhesive decoration and the second adhesive decoration; and wherein the lobe includes a through-hole extending therethrough.

17. The method of claim 14, wherein the method includes a step of affixing the wearable article to the charm by applying one or more attachment devices to the attachment member of the first adhesive decoration and the attachment member of the second adhesive decoration and to the wearable article so that the charm is suspended from the wearable article by the one or more attachment devices.

18. The method of claim 14, wherein step a) and step b) are repeated for a plurality of the first adhesive decorations and a plurality of the second adhesive decorations so that a plurality of charms are affixed to the wearable article.

* * * * *